US007980309B2

(12) United States Patent
Crawford

(10) Patent No.: US 7,980,309 B2
(45) Date of Patent: Jul. 19, 2011

(54) METHOD FOR SELECTIVE ACTIVATION OF DOWNHOLE DEVICES IN A TOOL STRING

(75) Inventor: Donald L. Crawford, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 304 days.

(21) Appl. No.: 12/112,016

(22) Filed: Apr. 30, 2008

(65) Prior Publication Data

US 2009/0272529 A1 Nov. 5, 2009

(51) Int. Cl.
*E21B 29/00* (2006.01)
*E21B 43/116* (2006.01)

(52) U.S. Cl. ..... 166/297; 166/55.1; 166/250.15; 175/4.55

(58) Field of Classification Search ..... 175/4.54, 175/4.55; 166/297, 55, 55.1, 250.15
See application file for complete search history.

(56) References Cited

U.S. PATENT DOCUMENTS

| | | | | |
|---|---|---|---|---|
| 4,051,907 | A | 10/1977 | Estes | |
| 4,355,310 | A | 10/1982 | Belaigues et al. | |
| 4,496,010 | A | 1/1985 | Chapman, III | |
| 4,527,636 | A | 7/1985 | Bordon | |
| 4,619,333 | A * | 10/1986 | George | 175/4.52 |
| 4,718,011 | A | 1/1988 | Patterson, Jr. | |
| 4,971,160 | A | 11/1990 | Upchurch | |
| 5,042,594 | A | 8/1991 | Gonzalez et al. | |
| 5,088,413 | A | 2/1992 | Huber et al. | |
| 5,347,929 | A | 9/1994 | Lerche et al. | |
| 5,505,134 | A | 4/1996 | Brooks et al. | |
| 5,691,712 | A | 11/1997 | Meek et al. | |
| 5,767,437 | A | 6/1998 | Rogers | |
| 6,105,688 | A * | 8/2000 | Vaynshteyn et al. | 175/4.54 |
| 6,283,227 | B1 | 9/2001 | Lerche et al. | |
| 6,497,284 | B2 * | 12/2002 | van Petegem et al. | 166/297 |
| 6,564,866 | B2 * | 5/2003 | Clark et al. | 166/250.12 |
| 6,604,584 | B2 | 8/2003 | Lerche et al. | |
| 6,820,693 | B2 * | 11/2004 | Hales et al. | 166/297 |
| 6,837,310 | B2 * | 1/2005 | Martin | 166/297 |
| 6,928,689 | B2 | 8/2005 | Dove | |
| 6,938,689 | B2 * | 9/2005 | Farrant et al. | 166/66 |
| 6,955,217 | B2 * | 10/2005 | Clark et al. | 166/250.01 |
| 7,132,958 | B2 | 11/2006 | Dodge et al. | |
| 7,207,216 | B2 * | 4/2007 | Meister et al. | 73/152.55 |
| 7,273,102 | B2 * | 9/2007 | Sheffield | 166/297 |
| 7,347,278 | B2 | 3/2008 | Lerche et al. | |

(Continued)

FOREIGN PATENT DOCUMENTS

CA 2 145 740 12/2007

(Continued)

*Primary Examiner* — Jennifer H Gay
(74) *Attorney, Agent, or Firm* — Lawrence R. Youst

(57) ABSTRACT

A system (100) for selective activation of explosive devices (126, 128, 130, 132) includes a surface controller (102), a downhole controller (106) operable to communicate bidirectionally with the surface controller over a first communication link (108) and a plurality of downhole remote units (114, 116, 118, 120) operable to communicate bidirectionally with the downhole controller (106) over a second communication link (112). One or more sensors (162) are operably associated with the downhole controller (106) and one of the explosive devices (126, 128, 130, 132) is operably associated with each of the downhole remote units (114, 116, 118, 120) such that, responsive to a detonation event, the sensors (162) detect the intensity level of the detonation which is communicated from the downhole controller (106) to the surface control (102) over the first communication link (108).

16 Claims, 4 Drawing Sheets

U.S. PATENT DOCUMENTS

| | | | | |
|---|---|---|---|---|
| 7,350,448 | B2 * | 4/2008 | Bell et al. | 89/1.15 |
| 7,383,882 | B2 * | 6/2008 | Lerche et al. | 166/250.01 |
| 7,661,366 | B2 * | 2/2010 | Fuller et al. | 102/275.8 |
| 2001/0015275 | A1 * | 8/2001 | van Petegem et al. | 166/297 |
| 2002/0112860 | A1 * | 8/2002 | McDaniel | 166/381 |
| 2003/0098157 | A1 * | 5/2003 | Hales et al. | 166/297 |
| 2003/0098799 | A1 * | 5/2003 | Zimmerman | 340/854.6 |
| 2004/0104029 | A1 * | 6/2004 | Martin | 166/298 |
| 2005/0045331 | A1 * | 3/2005 | Lerche et al. | 166/297 |
| 2005/0205302 | A1 * | 9/2005 | Meister et al. | 175/50 |
| 2005/0263286 | A1 * | 12/2005 | Sheffield | 166/297 |
| 2007/0125530 | A1 | 6/2007 | Lerche et al. | |
| 2008/0053658 | A1 * | 3/2008 | Wesson et al. | 166/297 |
| 2009/0084535 | A1 | 4/2009 | Bertoja et al. | |
| 2009/0250210 | A1 * | 10/2009 | Allen et al. | 166/250.15 |
| 2009/0272529 | A1 * | 11/2009 | Crawford | 166/250.15 |
| 2010/0133004 | A1 * | 6/2010 | Burleson et al. | 175/2 |

FOREIGN PATENT DOCUMENTS

| | | | |
|---|---|---|---|
| EP | 0 651 229 | A2 | 1/1994 |
| EP | 0 675 262 | A1 | 3/1995 |
| GB | 2 288 005 | A | 4/1995 |
| WO | WO/2008/100362 | A2 | 8/2008 |

* cited by examiner

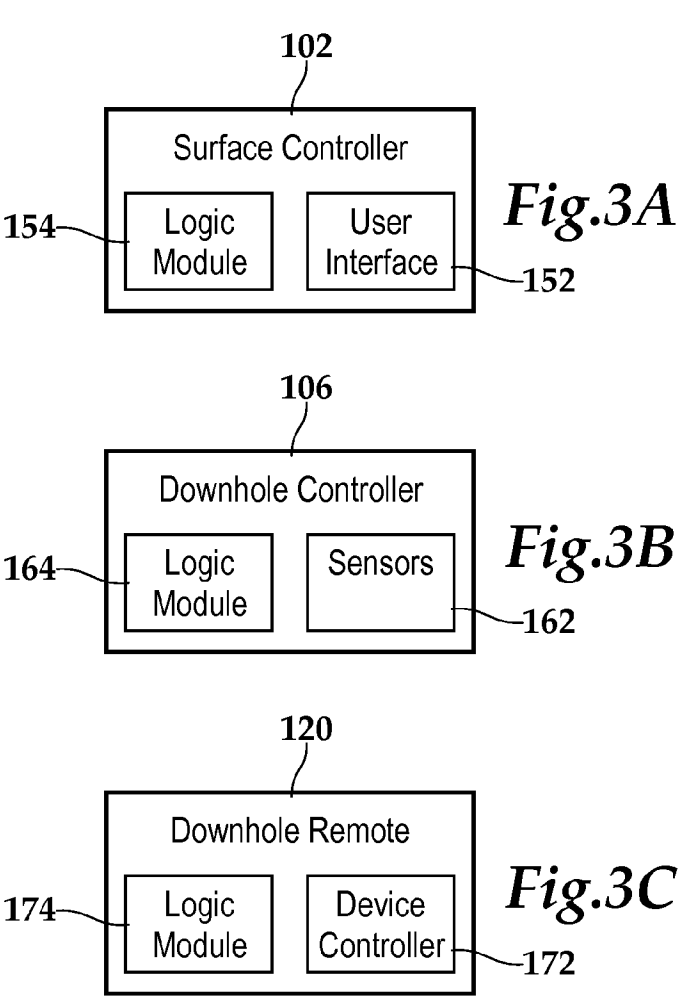
Fig.3A
Fig.3B
Fig.3C
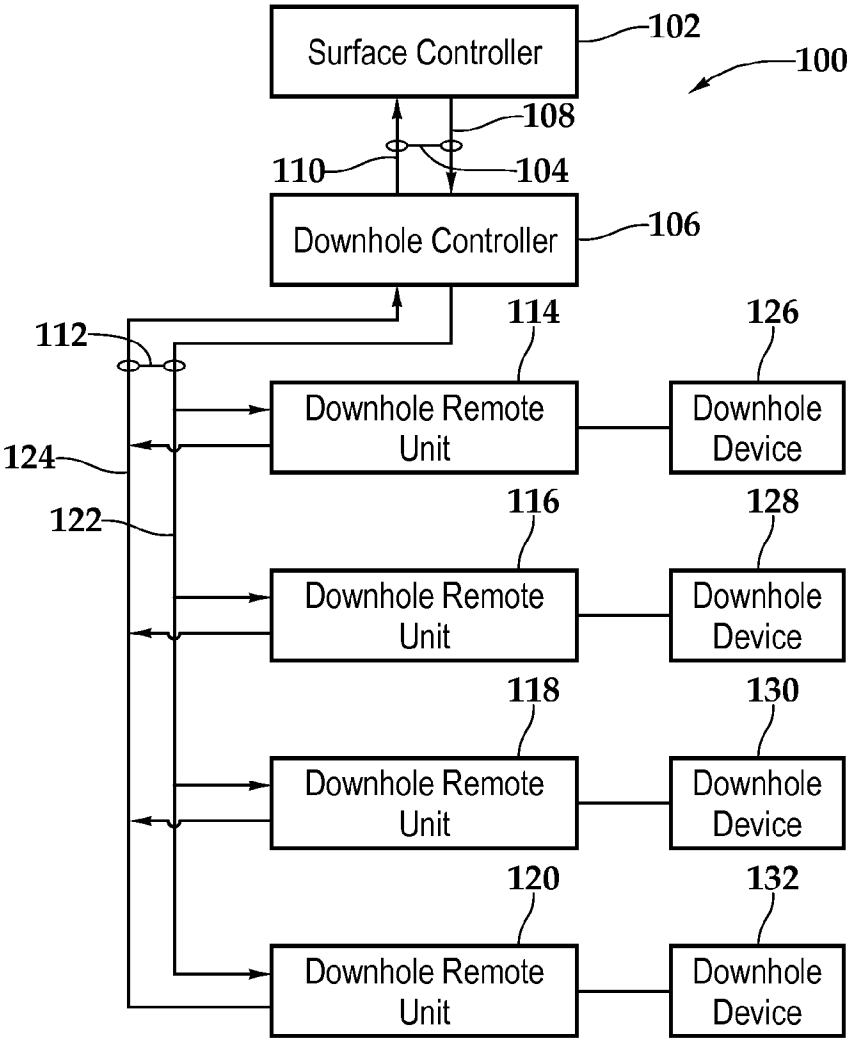
Fig.2

METHOD FOR SELECTIVE ACTIVATION OF DOWNHOLE DEVICES IN A TOOL STRING

TECHNICAL FIELD OF THE INVENTION

This invention relates, in general, to selective activation of downhole devices in a tool string and, in particular, to systems and methods for bidirectional communication between a surface system and a downhole system that enables individual addressing of and operational feedback from downhole devices.

BACKGROUND OF THE INVENTION

Without limiting the scope of the present invention, its background will be described in relation to activating perforating guns, as an example.

One of the typical steps in completing a well that traverses a hydrocarbon bearing subterranean formation is perforating the well casing to allow production of a hydrocarbon fluid such as oil or gas. In some wells, the hydrocarbon bearing subterranean formation is continuous, which allows the casing adjacent to the formation to be perforated in a single trip into the well with one or more guns that create openings along the entire productive zone. In other wells, however, it has been found that the productive zones of a formation are not continuous. For example, some formations may have non-productive streaks in the oil-bearing zone. In other cases, the well may traverse multiple formations that are separated by non productive intervals. In well having such multiple zones or multiple formations, it remains desirable to perforate the individual zones or formations at separate well depths during a single trip into a well.

Attempts have been made to perforate such multiple zones in a single trip using multi-gun strings and selective fired gun systems. Typically, the guns in such a multi-gun string are sequentially armed and fired starting from the lowermost gun and progressing to the uppermost gun using a variety of mechanical and electrical techniques. For example, in certain gun systems, each gun above the lowermost gun is sequentially activated responsive to the force of a detonation of the gun below. In such gun systems, mechanical switches are used to step through the guns from the bottom to the top. It has been found, however, that these selective fired gun systems encounter a number of problems. For example, certain guns in these selective fired gun systems may fail to fire because of assembly mistakes, mechanical integrity issues, switch failures and the like. In addition, it has been found, that guns may become prematurely armed due, for example, to electrical or mechanical failures which may lead to off depth firing of the misarmed gun. Also, in some systems, if any gun fails to fire for any reason, the gun above will not be armed and the firing sequence is stopped. As a result, the guns must be pulled out of the well for repair or replacement.

More recently, attempts have been made to improve selective fired gun systems by allowing downhole control units to be individually addressed by a surface system. In such systems, a request and response protocol has been used to allow communication between the surface system and the downhole control units such that the identity of the downhole control units may be confirmed prior to activating a gun. It has been found, however, that such individually addressable selective fired gun systems require each of the downhole control units to communicate over a long distance to the surface system. In addition, it has also been found, that such individually addressable selective fired gun systems fail to provide any information regarding the quality of the perforating results. For example, certain failures in firing, including low order firing, may go undetected with such systems resulting in non productive or under productive completions.

SUMMARY OF THE INVENTION

The present invention disclosed herein provides systems and methods for bidirectional communication between a surface system and a downhole system that enables individual addressing of and operational feedback from downhole devices. The systems and methods of the present invention enable such communication without the need for each of the downhole devices to communicate over a long distance to the surface system. In addition, systems and methods of the present invention provide for information regarding the quality of the perforating results to be obtained.

In one aspect, the present invention is directed to a system for selective activation of downhole devices in a tool string that is operably positionable in a wellbore. The system includes a surface controller, a downhole controller operable to communicate bidirectionally with the surface controller over a first communication link and a plurality of downhole remote units operable to communicate bidirectionally with the downhole controller over a second communication link. In response to a single enable command received over the first communication link from the surface controller, the downhole controller communicates with each of the downhole remote units over the second communication link to obtain status information therefrom and reports the status information relating to each of the downhole remote units to the surface controller over the first communication link.

In one embodiment, each of the downhole remote units has a fixed address wherein each of the fixed addresses may be a unique fixed address such as a unique frequency, a unique digital code or the like. In another embodiment, the first and second communication links may be wired communication links. In a further embodiment, the status information relating to each of the downhole remote units includes either a status of operational or a status of non operational.

In one embodiment, each of the downhole remote units is operable to activate an associated downhole device such as an explosive device, a perforating gun, a group of perforating guns, a cutting device, an actuator, an injector or the like. In this embodiment and responsive to the status information received relating to each of the downhole remote units, the surface controller sends a command to the downhole controller to activate a particular downhole device and the downhole controller sends an activation command to the downhole remote unit associated with the particular downhole device. In certain embodiments, the activation command may be a voltage, a current, a signal or the like.

In another aspect, the present invention is directed to a method for selective activation of downhole devices in a tool string that is operably positionable in a wellbore. The method includes providing a surface controller, positioning a downhole controller in the tool string, the downhole controller operable to communicate bidirectionally with the surface controller over a first communication link, positioning a plurality of downhole remote units in the tool string downhole of the downhole controller, the downhole remote units operable to communicate bidirectionally with the downhole controller over a second communication link, sending a single enable command from the surface controller to the downhole controller over the first communication link and, responsive to the enable command, the downhole controller communicating with each of the downhole remote units over the second communication link to obtain status information therefrom and reporting the status information relating to each of the downhole remote units to the surface controller over the first communication link.

The method may also include, responsive to the status information received relating to each of the downhole remote units, the surface controller sending a command to the downhole controller to activate a downhole device associated with one of the downhole remote units and the downhole controller sending an activation command to the downhole remote unit associated with the downhole device.

In a further aspect, the present invention is directed to a system for selective activation of downhole devices in a tool string that is operably positionable in a wellbore. The system includes a surface controller, a downhole controller operable to communicate bidirectionally with the surface controller over a first communication link and a plurality of downhole remote units operable to communicate bidirectionally with the downhole controller over a second communication link. One or more sensors are operably associated with the downhole controller and an explosive device is operably associated with each of the downhole remote units such that, responsive to a detonation of one of the explosive devices, the sensor detects an intensity level of the detonation which is communicated from the downhole controller to the surface controller over the first communication link.

In one embodiment, the surface controller sends a command to the downhole controller over the first communication link to initiate the detonation of the explosive device and the downhole controller sends a fire command to the downhole remote unit associated with the explosive device over the second communication link. In another embodiment, each of the explosive devices further comprises at least one perforating gun. In this embodiment, the sensor may include one or more accelerometers that are operable to detect the quality of the firing of the perforating gun.

In another aspect, the present invention is directed to a method for selective activation of downhole devices in a tool string that is operably positionable in a wellbore. The method includes providing a surface controller, positioning a downhole controller in the tool string, the downhole controller operable to communicate bidirectionally with the surface controller over a first communication link, positioning a plurality of downhole remote units in the tool string downhole of the downhole controller, the downhole remote units operable to communicate bidirectionally with the downhole controller over a second communication link, operably associating an explosive device with each of the downhole remote units, detonating one of the explosive devices, detecting an intensity level of the detonation and communicating the intensity level of the detonation from the downhole controller to the surface controller over the first communication link.

The method may also include sending a command from the surface controller to the downhole controller over the first communication link to initiate the detonation of the explosive device and sending a fire command from the downhole controller to the downhole remote unit associated with the explosive device over the second communication link. The method may further include detecting the intensity level of the detonation with at least one accelerometer such that the quality of the firing of a perforating gun may be determined.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which:

FIG. 2 is a communication diagram of a system for selective activation of downhole devices in a tool string that embodies principles of the present invention;

FIG. 3A is a functional block diagram of a surface controller of a system for selective activation of downhole devices in a tool string that embodies principles of the present invention;

FIG. 3B is a functional block diagram of a downhole controller of a system for selective activation of downhole devices in a tool string that embodies principles of the present invention;

FIG. 3C is a functional block diagram of a downhole remote unit of a system for selective activation of downhole devices in a tool string that embodies principles of the present invention;

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1A:
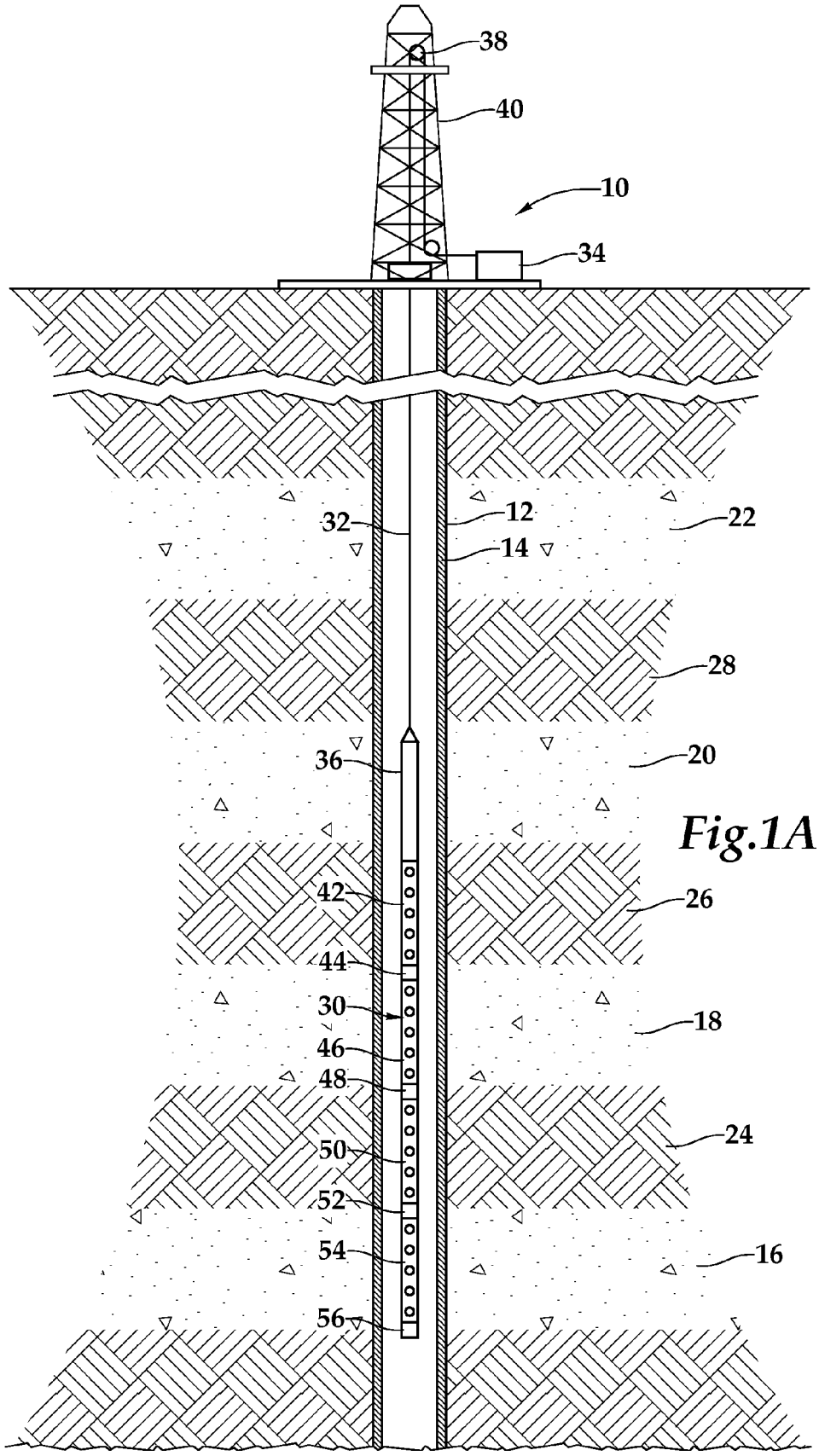
FIGS. 1A and 1B are schematic illustrations of a system for selective activation of downhole devices in a tool string that is positioned in a wellbore that embodies principles of the present invention.

Referring initially to FIG. 1A, therein is representatively illustrated a system for selective activation of downhole devices in a tool string that is positioned in a wellbore and is generally designated 10. System 10 is being operated in association with a wellbore 12 lined with casing 14. Wellbore 12 traverses various earth strata including hydrocarbon bearing formations 16, 18, 20, 22. Between each of the hydrocarbon bearing formations 16, 18, 20, 22 is a non productive interval. Specifically, non productive interval 24 is between formations 16, 18, non productive interval 26 is between formations 18, 20 and non productive interval 28 is between formations 20, 22. While the illustrated embodiment depicts four formations separated by three non productive intervals, those skilled in the art will recognize that system 10 is suitable for use within a wellbore that traverses any number of formations or production zones separated by a concomitant number of non productive intervals without departing from the principle of the present invention.

Wellbore 12 is depicted during the completion phase of the well. Specifically, a tool string 30 is suspended in wellbore 12 supported by a conveyance 32 such as a wireline or electric line. Conveyance 32 preferably includes one or more cables that are operable to transport and position tool string 30 within wellbore 12 and provide communication capability between a surface controller 34 and a downhole controller 36 when downhole controller 36 is positioned within wellbore 12. In addition, conveyance 32 may also be operable to provide power from the surface to downhole controller 36 as well as the other components within tool string 30. In the illustrated embodiments conveyance 32 is supported by a hoisting assembly 38 positioned within derrick 40.

In addition to downhole controller 36, tool string 30 includes a plurality of perforating guns each being associated with a downhole remote unit. In the illustrated embodiment, tool string 30 includes perforating gun 42 and downhole remote unit 44, perforating gun 46 and downhole remote unit 48, perforating gun 50 and downhole remote unit 52, and perforating gun 54 and downhole remote unit 56. While the illustrated embodiment depicts four perforating guns and four downhole remote units, those skilled in the art will recognize that system 10 may encompass any number of perforating guns and downhole remote units depending on the number of independent perforating events desired. In addition, those skilled in the art will recognize that more than one perforating gun may be associated with a single downhole remote unit, the number of perforating guns being dependent upon the length of the formation being perforated.

Figure 1B:
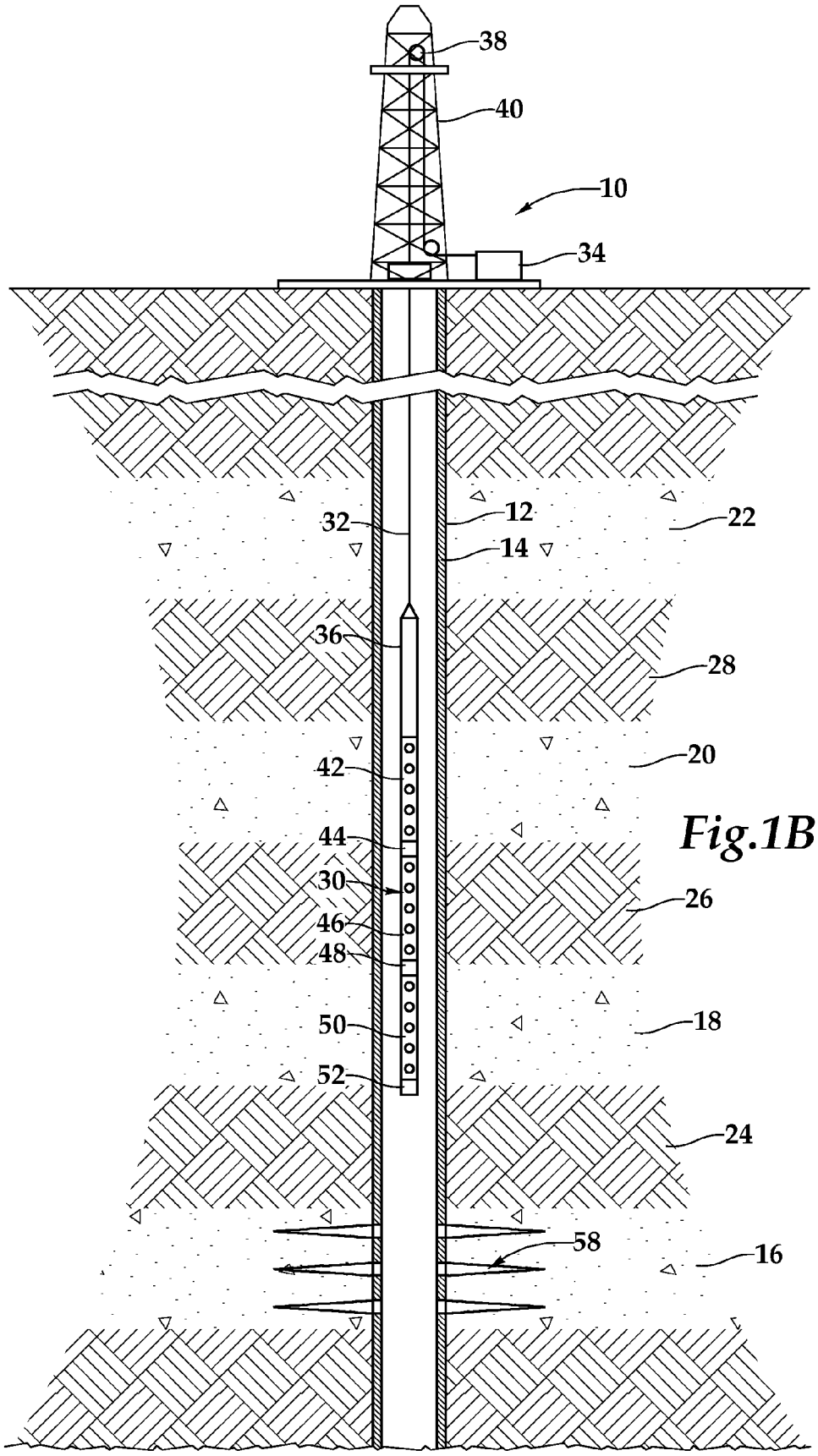

System 10 of the present invention enables the operator to control the detonation of individual perforating guns 42, 46, 50, 54 while obtaining definitive feedback relating to the outcome of the activation events downhole. As best seen in FIG. 1A, tool string 30 has been positioned within wellbore 12 such that perforating gun 54 is aligned with formation 16. Once system 10 is in this configuration, a sequence of commands and responses, as will be detailed below, is communicated between surface controller 34, downhole controller 36 and downhole remote units 44, 48, 52, 56 such that a desired one of the perforating guns, in this case perforating gun 54 may be fired. As best seen in FIG. 1B, after perforating gun 54 has been fired, perforations 58 have been made which will eventually allow production of the hydrocarbon fluids from formation 16 to enter wellbore 12, and feedback has been delivered regarding the quality of the perforating event, tool string 30 is raised such that perforating gun 50 is aligned with formation 18. Once system 10 is in this configuration, the sequence of commands and responses is repeated such that a desired one of the perforating guns, in this case perforating gun 50, may be fired and feedback regarding the quality of this perforating event is obtained. This process continues up tool string 30 sequentially firing guns 46, 42 to respectively perforate formations 20, 22. While the firing sequence has been described as progressing from the lowermost perforating gun 54 to the uppermost perforating gun 42, the system of the present invention in not limited to such a sequence. As more fully described below, each of the downhole remote units 44, 48, 52, 56 possesses a unique address such that the operator may choice to fire any of the available perforating guns by selecting the downhole remote unit associated with the desired perforating gun using the unique address of appropriate downhole remote unit.

Referring next to FIG. 2, therein is depicted a communication diagram of a system for selective activation of downhole devices in a tool string that is generally designated 100. System 100 includes a surface controller 102 that is coupled to a bidirectional communication link 104 that provides for communication between surface controller 102 and a downhole controller 106. As illustrated, communication link 104 includes a communication path 108 from surface controller 102 to downhole controller 106 and a communication path 110 from downhole controller 106 to surface controller 102. In certain embodiments, bidirectional communication may be achieved via a half duplex channel which allows only one of communication paths 108, 110 to be open in any time period. Preferably, bidirectional communication is achieved via a full duplex channel which allows simultaneous communication over communication paths 108, 110. This can be achieved, for example, by providing independent hardwire connections or over a shared physical media through frequency division duplexing, time division duplexing, echo cancellation or similar technique. In either case, communication link 104 may include one or more electrical conductors, optical conductors or other physical conductors. As described above, the downhole controller is supported within the wellbore on a conveyance such as an electric line that may be used to couple surface controller 102 to downhole controller 106. In this configuration, the conveyance preferably includes the physical media that provides communication link 104 including communication paths 108, 110. Accordingly, surface controller 102, downhole controller 106 and communication link 104 form a first communication network of system 100.

Downhole controller 106 is also coupled to a bidirectional communication link 112 that provides communication between downhole controller 106 and each of a plurality of downhole remote units 114, 116, 118, 120. As illustrated, communication link 112 includes a communication path 122 from downhole controller 106 to downhole remote units 114, 116, 118, 120 and a communication path 124 from downhole remote units 114, 116, 118, 120 to downhole controller 106. As described above, bidirectional communication may be achieved via a half duplex channel or preferably via a full duplex channel. The communication media of communication link 112 may be one or more electrical conductors, optical conductors or other physical conductors. Accordingly, downhole controller 106, downhole remote units 114, 116, 118, 120 and communication link 112 form a second communication network of system 100.

As downhole controller 106 is a component in both the first and the second communication networks of system 100, downhole controller 106 is operable to serve as a relay between surface controller 102 and downhole remote units 114, 116, 118, 120. This feature of the present invention enables each of the downhole remote units 114, 116, 118, 120 to operate at a lower power level as communications between downhole remote units 114, 116, 118, 120 and downhole controller 106 take place over a short distance whereas, communications between downhole controller 106 and surface controller 102 take place over a long distance requiring higher power. As such, the second communication network may operate at a lower power level then the first communication network.

In the illustrated embodiment, each of the downhole remote units 114, 116, 118, 120 is in communication with a downhole device. Specifically, downhole remote unit 114 is in communication with downhole device 126, downhole remote unit 116 is in communication with downhole device 128, downhole remote unit 118 is in communication with downhole device 130, and downhole remote unit 120 is in communication with downhole device 132. The communication path between respective downhole remote units and downhole devices may be bidirectional or unidirectional providing at least the ability to send a voltage, current or other signal from the downhole remote unit to the downhole device to activate the downhole device. In the case of the downhole devices being perforating guns, a voltage signal such as 40 volts, 200 volts or other voltage may desirable. Those skilled in the art will recognize, however, that the signal sent from a downhole remote unit to a downhole device to activate that downhole device will depend on the type of downhole device being activated. For example, the downhole remote units of the present invention are suitable for activating a variety of downhole devices including, but not limited to, explosive devices, perforating guns, cutting devices, actuators, injectors and the like.

Referring next to FIG. 3A, therein is depicted a functional block diagram of surface controller 102 that is operable in the system for selective activation of downhole devices in a tool string of the present invention. Surface controller 102 includes a user interface 152 including, for example, input and output devices such as one or more video screens or monitors, including touch screens, one or more keyboards or keypads, one or more pointing or navigation devices, as well as any other user interface devices that are currently known to those skilled in the art or are developed. The user interface 152 may take the form of a computer including a notebook computer.

Surface controller 102 also includes a logic module 154 that may include various controllers, processors, memory components, operating systems, instructions, communication protocols and the like for implementing the systems and methods for selective activation of downhole devices in a tool string of the present invention. In one embodiment, logic module 154 is operable to communicate via communication link 104 (FIG. 2) with downhole controller 106. Logic module 154 is operable to issue commands to the downhole controller 106 and receive information from the downhole controller 106. As an example, logic module 154 may issue an enable command which initiates a status check of downhole controller 106 as well as a status check of the downhole remote units 114, 116, 118, 120. The status information returned to logic module 154 may include the operational or short/fault/non operational status of each of the downhole remote units. As another example, logic module 154 may issue a command to activate one of the downhole devices associated with a downhole remote unit. In a perforating gun system implementation, logic module 154 preferably commands the deepest downhole remote unit, downhole remote unit 120, to activate its downhole device 132. Alternatively, logic module 154 may send a command to a less deep downhole remote unit using that downhole remote unit's unique address. It should be noted by those skilled in the art, that in a perforating gun system implementation, certain commands from surface controller 102 may be deliberately complex to assure the desired degree of safety. For example, logic module 154 may require a multiple step process using multiple codes from the user to achieve an explosive event. As a further example, logic module 154 may receive feedback associated with the operational states of the associated downhole devices. For example, in a perforating gun system implementation, logic module 154 may receive feedback information giving the operator a definite confirmation regarding the occurrence and quality of an explosive event.

As should be understood by those skilled in the art, any of the functions described with reference to a logic module herein can be implemented using software, hardware including fixed logic circuitry, manual processing or a combination of these implementations. As such, the term "logic module" as used herein generally represents software, hardware or a combination of software and hardware. For example, in the case of a software implementation, the term "logic module" represents program code and/or declarative content, e.g., markup language content, that performs specified tasks when executed on a processing device or devices such as one or more processors or CPUs. The program code can be stored in one or more computer readable memory devices. More generally, the functionality of the illustrated logic modules may be implemented as distinct units in separate physical grouping or can correspond to a conceptual allocation of different tasks performed by a single software program and/or hardware unit. The illustrated logic modules can be located at a single site such as implemented by a single processing device, or can be distributed over plural locations such as a notebook computer or personal digital in combination with other physical devices that communication with one another via wired or wireless connections.

Referring next to FIG. 3B, therein is depicted a functional block diagram of a downhole controller 106 that is operable in the system for selective activation of downhole devices in a tool string of the present invention. Downhole controller 106 includes a plurality of sensors 162 including, for example, one or more accelerometers, pressure sensors including high speed pressure sensors, temperature sensors, voltage and current sensors, a casing collar locator, a gamma detector as well as other sensors known to those skilled in the art. Using these sensors, downhole controller 106 is operable to provide feedback to surface controller 102 regarding a variety of downhole conditions and events. For example, correlation information may be obtained using the casing collar locator as well as the gamma detector. As another example, in a perforating gun system implementation, the accelerometers, pressure sensors, high speed pressure sensors and temperature sensors allow substantially real time analysis of the near perforation events. Also, in the case of a perforating gun system implementation, the voltage and current sensors may be used to determine the occurrence or non occurrence of a perforating event.

Downhole controller 106 also includes a logic module 164 that includes various controllers, processors, memory components, operating systems, instructions, communication protocols and the like for implementing the systems and methods for selective activation of downhole devices in a tool string of the present invention. As explained above, logic module 164 is an active part of the first and the second communication networks of the system of the present invention. Logic module 164 acts as a relay for bridging the communications between surface controller 102 and downhole remote units 114, 116, 118, 120. Logic module 164 is operable to received commands from surface controller 102 and relay such commands to one or more of the downhole remote units. In addition, logic module 164 is operable to received feedback corresponding to the commands from the downhole remote units which is relayed to surface controller 102. For example, logic module 164 may receive an enable command from surface controller 102. In this case, logic module 164 relays this command to each of the downhole remote units 114, 116, 118, 120. After each of the operational downhole remote units responds to logic module 164, logic module 164 returns the status information, such as the operational or short/fault/non operational status of each of the downhole remote units to surface controller 102.

Referring next to FIG. 3C, therein is depicted a functional block diagram of a downhole remote unit 120 that is operable in a system for selective activation of downhole devices in a tool string of the present invention. Downhole remote unit 120 includes a device controller 172 that is operable to send a signal to a downhole device, such as downhole device 132, to activate that downhole device. In the case of a perforating gun system implementation, device controller 172 may include one or more leads that provide or prevent a current from passing to the downhole device. In this configuration, the circuitry of the downhole device may be held at ground or shunted as a safety feature until such time as device controller 172 is instructed to allow a current to pass thereto. This feature allows all downhole remote units to be fully tested without inadvertently initializing one of the downhole devices.

Downhole remote unit 120, which is representative of each of the downhole remote units but has been described as being the lowermost downhole remote unit, includes a logic module 174 that includes, for example, various fixed logic circuits, controllers, processors, memory components, operating systems, instructions, communication protocols and the like for implementing the systems and methods for selective activation of downhole devices in a tool string of the present invention. Each of the downhole remote units is substantially similar, however, each includes its own unique address, such as an eight, sixteen, thirty-two or other bit unique digital address. Logic module 174 is operable to receive an enable command sent from downhole controller 106, which may simply be a power on signal. Once the enable command is received, each of the downhole remote units sequentially goes through an automated initialization process, as explained in greater detail below. This process results in the operational downhole remote units returning a positive status signal to downhole controller 106, which is passed to surface controller 102. Thereafter, the logic module 174 of any one of the operational downhole remote units may be addressed by surface controller 102 via downhole controller 106 to activate an associated downhole device.

Figure 4:
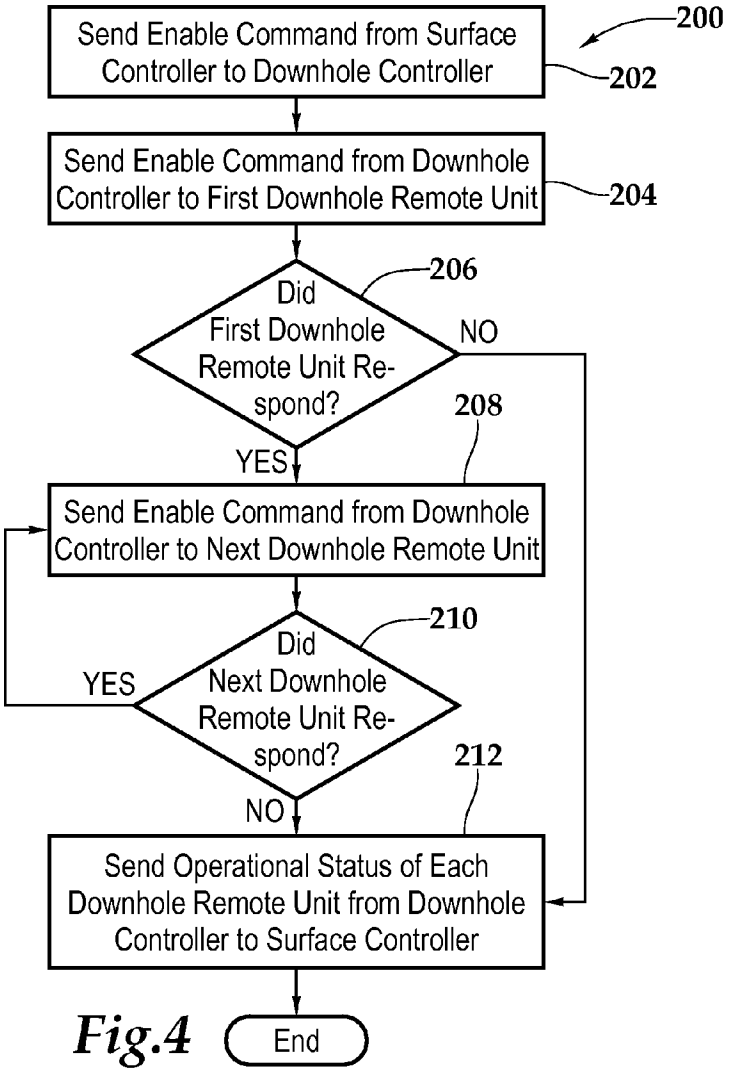
FIG. 4 is a flow chart illustrating a method for selective activation of downhole devices in a tool string that embodies principles of the present invention.

An operation of the present invention that is generally designated 200 will now be more specifically described with reference to FIG. 4. By sending a single enable command (step 202) to the downhole controller, the surface controller can obtain status information relating to the downhole remote units of the system of the present invention. In this process, the enable command is sent from the surface controller to the downhole controller over a first bidirectional communication link that may be operably associated with a conveyance such as an electric line or wireline. In turn, the downhole controller sends the enable command to the first downhole remote unit of the tool string (step 204) over a second bidirectional communication link. In certain embodiments, the enable command sent from the downhole controller may include the address of the downhole remote unit, such as a sixteen bit address, an argument containing an instruction for the downhole remote unit, such as a sixteen bit argument, and a redundancy check, such as a checksum or other error checking functionality to assure there is no corruption in the enable command.

If the first downhole remote unit of the tool string does not respond (decision 206), then the downhole controller reports back to the surface controller that the system failed to initialize. If the first downhole remote unit of the tool string is operational, it sends a response back to the downhole controller (decision 206). The response may be, for example, an echo of the downhole remote unit's address or other data string. Once the first downhole remote unit responds, an enable command is sent to the next downhole remote unit down the tool string (step 208) by either the downhole controller sending an enable command directly to the next downhole remote unit after receiving confirmation from the prior downhole remote unit or by the prior downhole remote unit passing on the previously received enable command. After each subsequent downhole remote unit responds to the enable command (decision 210), the next lower downhole remote unit receives an enable command (step 208). Once the enable process has progressed to the last operational downhole remote unit, for example, a short circuit or an open circuit is found, no further response is received by the downhole controller (decision 210). The downhole controller may now send the operational status of each of the downhole remote units to the surface controller (step 212) over the first communication link.

Once all the operational downhole remote units are identified, the initialization process may be repeated to confirm operational status, if desired. On the second pass initialization, all operational downhole remote units may be reinitialized. In this verification step, no enable command is sent to the downhole remote unit that did not previously respond. Alternatively, a command may be sent from the surface system to attempt initialization of all the downhole remote units including the one that did not previously respond.

Figure 5:
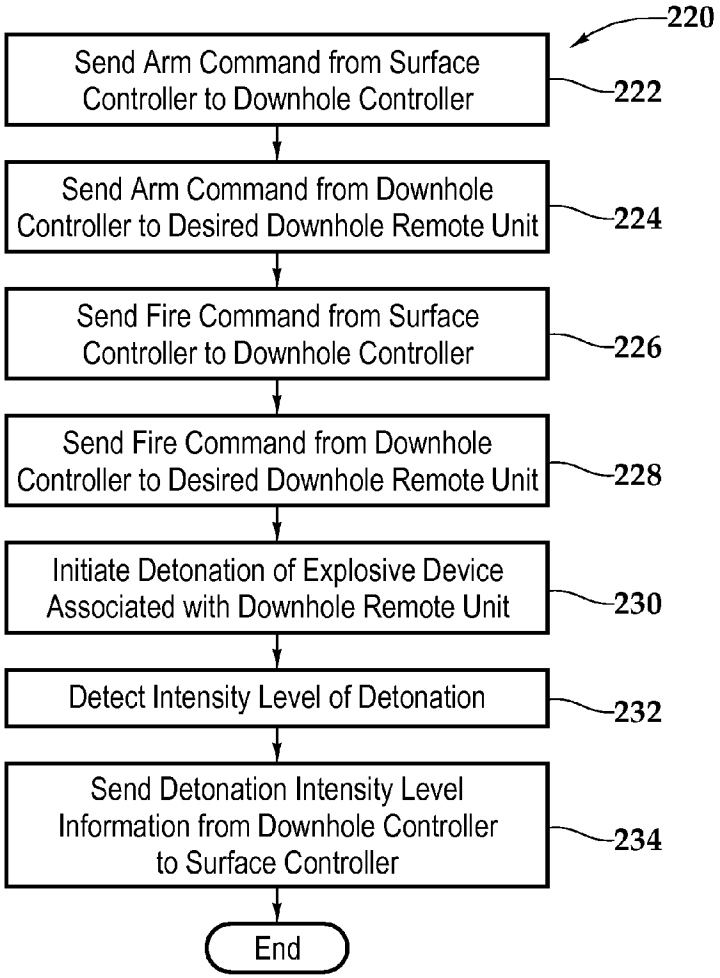
FIG. 5 is a flow chart illustrating a method for selective activation of downhole devices in a tool string that embodies principles of the present invention.

An operation of the present invention that is generally designated 220 will now be more specifically described with reference to FIG. 5. Once the initialization process is complete, the surface controller may send additional commands directed to a specific downhole remote unit to initiate an operation of a desired downhole device, which, in the present example, is a perforating gun. The surface controller sends an arm command to the downhole controller (step 222) over the first bidirectional communication link that is intended for a desired downhole control unit which may be specified using the address of the desired downhole control unit. The downhole controller receives the arm command from the surface controller and relays the command down the second bidirectional communication link to the desired downhole control unit (step 224). Similar to the enable command, the arm command may be formatted as a three word series containing the desired downhole control unit's address, the command argument, and a redundancy check to validate the command sequence. This arm command may be used to open a switch, burn a fuse, charge a diode or otherwise establish a state in the downhole control unit that will allow a further command to initiate the firing of the associated perforating gun.

Once this state is established in the downhole control unit, a response may be sent to the surface controller via the downhole controller to acknowledge this state. Thereafter, the surface controller sends a fire command to the downhole controller (step 226) over the first bidirectional communication link that is intended for the desired downhole control unit which may be specified using the address of the desired downhole control unit. The downhole controller receives the fire command from the surface controller and relays the command down the second bidirectional communication link to the desired downhole control unit (step 228). Similar to the enable and arm commands, the fire command may be formatted as a three word series containing the desired downhole control unit's address, the command argument and a redundancy check to validate the command sequence. This fire command may be used by the downhole remote unit to establish an initiation voltage or signal which is applied to the perforating gun to initiate the detonation of the perforating gun (step 230).

During the detonation process, the sensors associated with the downhole controller gather information relating to the detonation event. Specifically, sensors such as the above described accelerometers, pressure sensors, high speed pressure sensors, temperature sensors and the like are used to obtain a variety of data near the detonation event. For example, the high speed pressure sensors is operably to obtain pressure data in the millisecond range such that the pressure surge and associated pressure cycles created by the detonation event can be measured. Likewise, the accelerometers are operable to record shock data associated with the detonation event. Use of this and other data provide for a determination of the intensity level of the detonation associated with the detonation event. This information is communicated from the downhole controller to the surface controller over the first communication link (step 234). This information may be used to determine the quality of the perforating event such as whether the initiator was detonated, whether any of the shaped charges within the perforating gun were detonated, whether all of the shaped charges within the perforating gun were detonated or whether only some of the shaped charges within the perforating gun were detonated. This information will allow the operator in substantially real time to determine if a zone should be reperforated. Preferably, after each zone is perforated, the tool string is repositioned within the wellbore to a desired location and the system of the present invention is reinitialized for each subsequent operation.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A single trip method for selective activation of perforating guns in a tool string that is operably positionable in a wellbore, the method comprising:

providing a surface controller;

positioning a downhole controller in the tool string, the downhole controller operable to communicate bidirectionally with the surface controller over a first communication link;

positioning a plurality of downhole remote units in the tool string downhole of the downhole controller, the downhole remote units operable to communicate bidirectionally with the downhole controller over a second communication link;

operably associating a perforating gun with each of the downhole remote units;

positioning the tool string in the wellbore such that a first perforating gun is located proximate a first zone;

sending a fire command sent over the first communication link from the surface controller to the downhole controller;

sending a fire command over the second communication link from the downhole controller to the first perforating gun to perforate the first zone;

detonating the first perforating gun;

detecting data associated with the detonation of the first perforating gun with a plurality of sensors operably associated with the downhole controller;

determining an intensity level of the detonation using the data from the plurality of sensors;

communicating the intensity level of the detonation from the downhole controller to the surface controller over the first communication link;

determining that the first zone should be reperforated based upon the intensity level of the detonation; and repositioning the tool string in the wellbore such that a second perforating gun is located proximate the first zone.

2. The method as recited in claim 1 wherein determining an intensity level of the detonation further comprising data from at least one accelerometer.

3. The method as recited in claim 1 further comprising using the intensity level to determine the quality of the firing of a perforating gun.

4. The method as recited in claim 1 wherein determining an intensity level of the detonation further comprising using data from a high speed pressure sensor and an accelerometer.

5. The method as recited in claim 1 further comprising using the intensity level to determine whether an initiator of the first perforating gun was detonated.

6. The method as recited in claim 1 further comprising using the intensity level to determine whether any shaped charges of the first perforating gun were detonated.

7. The method as recited in claim 1 further comprising using the intensity level to determine whether all shaped charges of the first perforating gun were detonated.

8. The method as recited in claim 1 further comprising using the intensity level to determine whether some shaped charges of the first perforating gun were detonated.

9. A single trip method for selective activation of perforating guns in a tool string that is operably positionable in a wellbore, the method comprising:

providing a surface controller;

positioning a downhole controller in the tool string, the downhole controller operable to communicate bidirectionally with the surface controller over a first communication link;

positioning a plurality of downhole remote units in the tool string downhole of the downhole controller, the downhole remote units operable to communicate bidirectionally with the downhole controller over a second communication link;

operably associating a perforating gun with each of the downhole remote units;

positioning the tool string in the wellbore such that a first perforating gun is located proximate a first zone;

sending a fire command sent over the first communication link from the surface controller to the downhole controller;

sending a fire command over the second communication link from the downhole controller to the first perforating gun to perforate the first zone;

detonating the first perforating gun;

detecting data associated with the detonation of the first perforating gun with a plurality of sensors operably associated with the downhole controller;

determining an intensity level of the detonation using the data from the plurality of sensors;

communicating the intensity level of the detonation from the downhole controller to the surface controller over the first communication link;

determining that the first zone should not be reperforated based upon the intensity level of the detonation; and repositioning the tool string in the wellbore such that a second perforating gun is located proximate a second zone.

10. The method as recited in claim 9 wherein determining an intensity level of the detonation further comprising data from at least one accelerometer.

11. The method as recited in claim 1 further comprising using the intensity level to determine the quality of the firing of a perforating gun.

12. The method as recited in claim 9 wherein determining an intensity level of the detonation further comprising using data from a high speed pressure sensor and an accelerometer.

13. The method as recited in claim 1 further comprising using the intensity level to determine whether an initiator of the first perforating gun was detonated.

14. The method as recited in claim 1 further comprising using the intensity level to determine whether any shaped charges of the first perforating gun were detonated.

15. The method as recited in claim 9 further comprising using the intensity level to determine whether all shaped charges of the first perforating gun were detonated.

16. The method as recited in claim 1 further comprising using the intensity level to determine whether some shaped charges of the first perforating gun were detonated.

* * * * *